US010053882B2

(12) United States Patent
Goettl

(10) Patent No.: US 10,053,882 B2
(45) Date of Patent: Aug. 21, 2018

(54) POOL RETURN FITTING ASSEMBLY

(71) Applicant: GSG Holdings, Inc., Chandler, AZ (US)

(72) Inventor: John M. Goettl, Phoenix, AZ (US)

(73) Assignee: GSG Holdings, Inc., Chandler, AZ (US)

( * ) Notice: Subject to any disclaimer, the term of this patent is extended or adjusted under 35 U.S.C. 154(b) by 28 days.

(21) Appl. No.: 15/379,389

(22) Filed: Dec. 14, 2016

(65) Prior Publication Data

US 2017/0198487 A1 Jul. 13, 2017

Related U.S. Application Data

(60) Provisional application No. 62/278,316, filed on Jan. 13, 2016.

(51) Int. Cl.
*E04H 4/00* (2006.01)
*E04H 4/12* (2006.01)

(52) U.S. Cl.
CPC ..... *E04H 4/12* (2013.01)

(58) Field of Classification Search
CPC ..... E04H 4/12
USPC ..... 4/507, 541.1, 541.6
See application file for complete search history.

(56) References Cited

U.S. PATENT DOCUMENTS 8,695,128 B1 * 4/2014 Busbey ..... A61H 33/6063 4/507
2013/0117924 A1 * 5/2013 Barnett ..... E04H 4/14 4/504
2017/0239138 A1 * 8/2017 Afshar ..... A61H 33/6063

* cited by examiner

*Primary Examiner* — Christine Skubinna
(74) *Attorney, Agent, or Firm* — Booth Udall Fuller, PLC

(57) ABSTRACT

A pool return fitting assembly with a pool return body, a pool return cover with an opening aligned with the pool return body's opening. The outer surface of the pool return cover may include an uneven surface bordering the opening with barriers projecting out from the pool return cover away from the pool return body, the barriers separated by channels in fluid communication with the opening through the pool return cover. A fin is positioned within the opening of the pool return cover and tapers towards the interior surface of the pool return body as the fin extends farther away from the pool return cover.

19 Claims, 12 Drawing Sheets

POOL RETURN FITTING ASSEMBLY

RELATED APPLICATIONS

This application claims the benefit of U.S. provisional patent application No. 62/278,316, filed Jan. 13, 2016 titled "Pool Return Fitting Assembly," the entirety of the disclosure of which is hereby incorporated by this reference.

TECHNICAL FIELD

Aspects of this document relate generally to return fitting assemblies for pools.

BACKGROUND

Conventional pool return fittings are designed for returning water from the pump system back to the pool. Most include sleek and attractive outer coverings to blend into the side of the pool. Many are also adapted with structures, such as dividers partitioning the return opening, to prevent small appendages, like a child's hand, from being inserted into the return fitting opening to reduce the risk of a body part getting stuck in the opening and trapping the child under water.

Under certain circumstances, for example when a pool skimmer basket becomes plugged by debris, the pool pump that normally pulls water from the pool through the pool skimmer basket may instead pull water through the pool return associated with the skimmer, causing the pool return to suck rather than blow. This creates a risk that a swimmer, their hair, or their clothing may become entrapped by the pool return, trapping the swimmer under water.

When a pool return has unexpectedly switched from emitting water to sucking it in, dividers or other structures meant to keep small hands out now create a new danger. The hair or clothing of a swimmer may be sucked into the pool return, beyond the safety structure. The suction may cause the hair or clothing to twist or tangle on the other side of the safety structure, effectively tying the swimmer to the pool return fitting, trapping them underwater.

Additionally, if the pool return begins to suck, the smooth, continuous outer covering of a conventional pool return fitting becomes a surface that can form a seal with a swimmer's body, the pump's suction holding them underwater. These configurations are dangerous and potentially fatal for pool users if the return pipe begins sucking water from the pool through the pool return fitting assembly.

SUMMARY

According to an aspect of the disclosure, a pool return fitting assembly may comprise a pool return body comprising an opening therethrough, a pool return cover comprising an opening therethrough aligned with the pool return body opening, the pool return cover comprising an uneven surface bordering the pool return cover opening and comprising a plurality of barriers projecting out from the pool return cover away from the pool return body, the plurality of barriers separated by channels in fluid communication with the opening through the pool return cover, and a fin positioned within the opening of the pool return cover, the fin comprising a facial edge and an internal edge, the facial edge extending from a facial point to one of the pool return body and the pool return cover, and the internal edge extending from the facial point to a tail point proximate an interior surface of the pool return body, wherein at least a portion of the internal edge of the fin tapers towards the interior surface of the pool return body as the fin extends farther away from the pool return cover.

Particular embodiments may comprise one or more of the following features. The internal edge of the fin may be shaped and positioned about a center of the opening of the pool return cover such that a largest radius of a sphere able to pass through the pool return cover opening around the fin is no larger than ½". The uneven surface may comprise a plurality of protrusions comprising at least a first protrusion of a first type and at least a second protrusion of a second type that differs from the first type by at least one of a dimension and a shape. The pool return body may be integrated with the pool return cover and the fin. The fin may further comprise a tab extending through the pool return body, the tab directly coupled to an edge of the pool return body. The pool return body may be sized to fit inside a pool return pipe. A pool return fitting base may have a mounting flange surrounding a first end sized to receive the pool return body, the first end of the base opposite a second end sized to receive a pool return pipe, wherein the pool return body is inside the first end of the base, such that an exterior surface of the pool return body is coupled to an interior surface of the pool return fitting base. The interior surface of the pool return fitting base may comprise an internal lip. An edge of the pool return body farthest from the pool return cover may be mated with the internal lip such that an interior surface of the pool return body is substantially flush with an interior surface of the internal lip facing a central axis of the pool return fitting base. The internal lip may be sized such that the interior surface of the internal lip is configured to be substantially flush with an interior surface of a pool return pipe when the pool return pipe is received through the second end of the pool return fitting base. The interior surface of the pool return fitting base may comprise a first threaded surface proximate the first end and the pool return body may be threadedly coupled to second threaded surface of the pool return fitting base through a threaded collar, the threaded collar having a threaded exterior surface and an interior surface directly coupled to the exterior surface of the pool return body, wherein an exterior surface of the pool return fitting base comprises a first threaded surface proximate the mounting flange which is threadedly coupled to a threaded backing nut. A height of any point on the internal edge between the facial point and the tail point may be defined by a continuous single-valued function depending at least on a depth of the point, wherein the depth of the point is measured as the distance of a point normal to the opening of the pool return cover, and the height of the point is measured as the distance of a point normal to an interior surface of the pool return body. The continuous single-valued function may be one-to-one, and The height of the tail point may be less than the height of the facial point.

According to an aspect of the disclosure, a pool return fitting assembly may comprise a pool return body comprising an opening therethrough, and a pool return cover comprising an opening therethrough aligned with the pool return body opening, the pool return fitting assembly consisting essentially of only one fin positioned within the opening of the pool return cover, the one fin comprising a facial edge and an internal edge, the facial edge extending from a facial point on the one fin to one of the pool return body and the pool return cover, and the internal edge extending from the facial point to a tail point proximate an interior surface of the pool return body, wherein at least a portion of the internal edge of the one fin tapers towards the interior surface of the pool return body as the one fin extends farther away from the pool return cover.

Particular embodiments may comprise one or more of the following features. The pool return cover may further comprise an uneven surface bordering the pool return cover opening and comprising a plurality of protrusions projecting out from the pool return cover away from the pool return body, the plurality of protrusions separated by channels in fluid communication with the opening through the pool return cover. The plurality of protrusions may form a wall comprising a plurality of channels and a plurality of barriers. The plurality of barriers may comprise at least one barrier of a first type and at least one barrier of a second type that differs from the first type by at least one of a dimension and a shape. The one fin may be sized and positioned such that a radius of a largest sphere able to pass through the aperture and pool return body around the one fin is no larger than ½". The interior surface of the pool return fitting base may comprise an internal lip, wherein an edge of the pool return body farthest from the pool return cover is mated with the internal lip such that an interior surface of the pool return body is substantially flush with an interior surface of the internal lip facing a central axis of the pool return fitting base, and the internal lip is sized such that the interior surface of the internal lip is configured to be substantially flush with an interior surface of a pool return pipe when the pool return pipe is received through the second end of the pool return fitting base. A height of any point on the internal edge between the facial point and the tail point may be defined by a continuous single-valued function depending at least on a depth of the point, wherein the height of the tail point is less than the height of the facial point. A pool return fitting base may have a mounting flange surrounding a first end sized to receive the pool return body, the first end opposite a second end sized to receive a pool return pipe, wherein the pool return body is inside the first end such that an exterior surface of the pool return body is coupled to an interior surface of the pool return fitting base.

The foregoing and other aspects, features, and advantages will be apparent to those artisans of ordinary skill in the art from the DESCRIPTION and DRAWINGS, and from the CLAIMS.

BRIEF DESCRIPTION OF THE DRAWINGS

The inventions will hereinafter be described in conjunction with the appended drawings, where like designations denote like elements, and.

DETAILED DESCRIPTION

Figure 1:
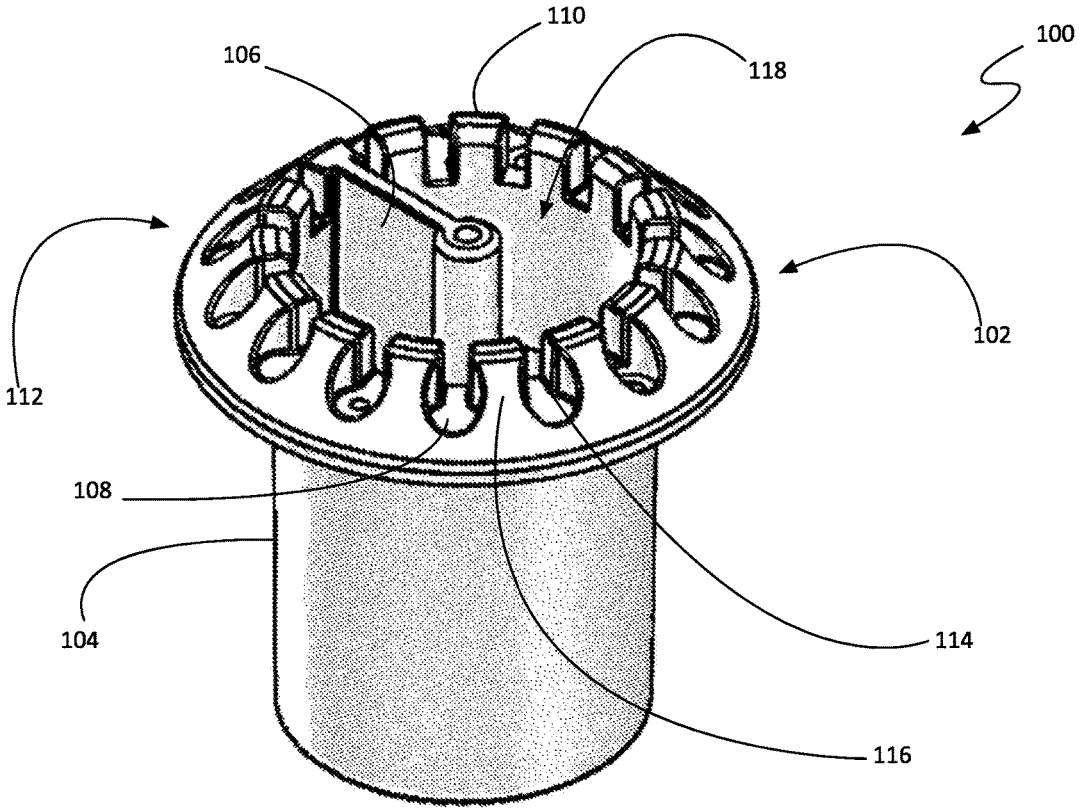
FIG. 1 is a perspective view of a pool return fitting assembly.

This disclosure, its aspects and implementations, are not limited to the specific fitting assembly or material types, or other system component examples, or methods disclosed herein. Many additional components, manufacturing and assembly procedures known in the art consistent with fitting assembly manufacture are contemplated for use with particular implementations from this disclosure. Accordingly, for example, although particular implementations are disclosed, such implementations and implementing components may comprise any components, models, types, materials, versions, quantities, and/or the like as is known in the art for such systems and implementing components, consistent with the intended operation.

The word "exemplary," "example," or various forms thereof are used herein to mean serving as an example, instance, or illustration. Any aspect or design described herein as "exemplary" or as an "example" is not necessarily to be construed as preferred or advantageous over other aspects or designs. Furthermore, examples are provided solely for purposes of clarity and understanding and are not meant to limit or restrict the disclosed subject matter or relevant portions of this disclosure in any manner. It is to be appreciated that a myriad of additional or alternate examples of varying scope could have been presented, but have been omitted for purposes of brevity.

While this disclosure includes a number of embodiments in many different forms, there is shown in the drawings and will herein be described in detail particular embodiments with the understanding that the present disclosure is to be considered as an exemplification of the principles of the disclosed methods and systems, and is not intended to limit the broad aspect of the disclosed concepts to the embodiments illustrated.

Contemplated as part of this disclosure are various embodiments of a pool return fitting. A pool return fitting assembly, according to this disclosure, is sized to fit and/or couple to a pool return pipe, as shall be described in greater detail below. In some embodiments, the return pipe extends between a skimmer housing and a pool, with the pool return fitting assembly being coupled to the return pipe at the pool. More particularly, the return pipe extends between the skimmer housing and a pool, and may be associated with a venturi system positioned to spray or otherwise direct fluid through the return pipe into the pool. Non-limiting examples of skimmer systems and venturi systems are included in U.S. patent application Ser. No. 14/980,579, the disclosure of which is hereby incorporated by reference.

Figure 2:
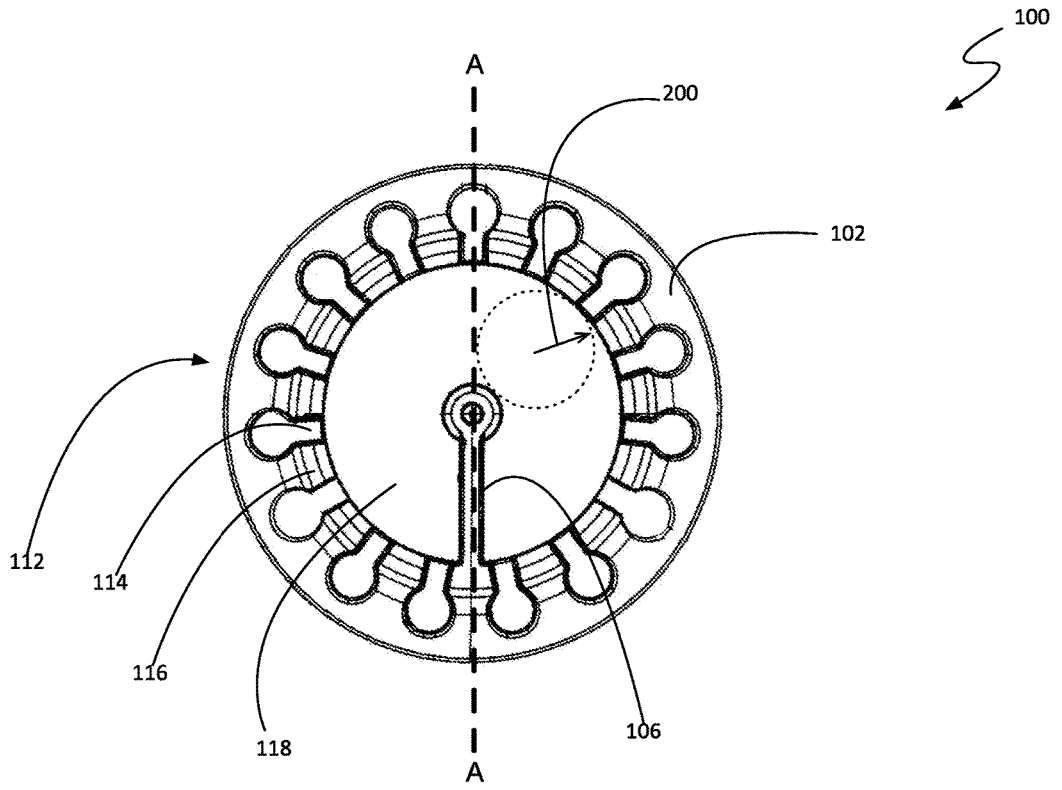
FIG. 2 is a front view of the pool return fitting assembly of FIG. 1.
Figure 3:
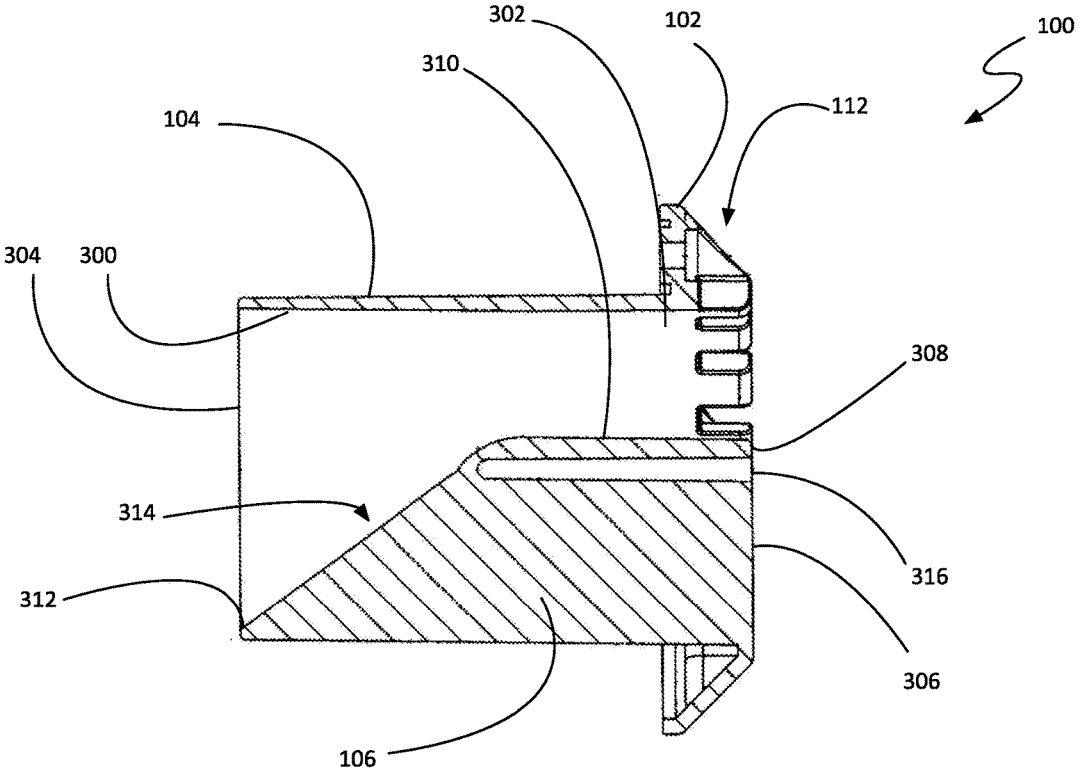
FIG. 3 is a cross sectional view of the pool return fitting assembly of FIG. 1 taken along section line A-A.
Figure 5:
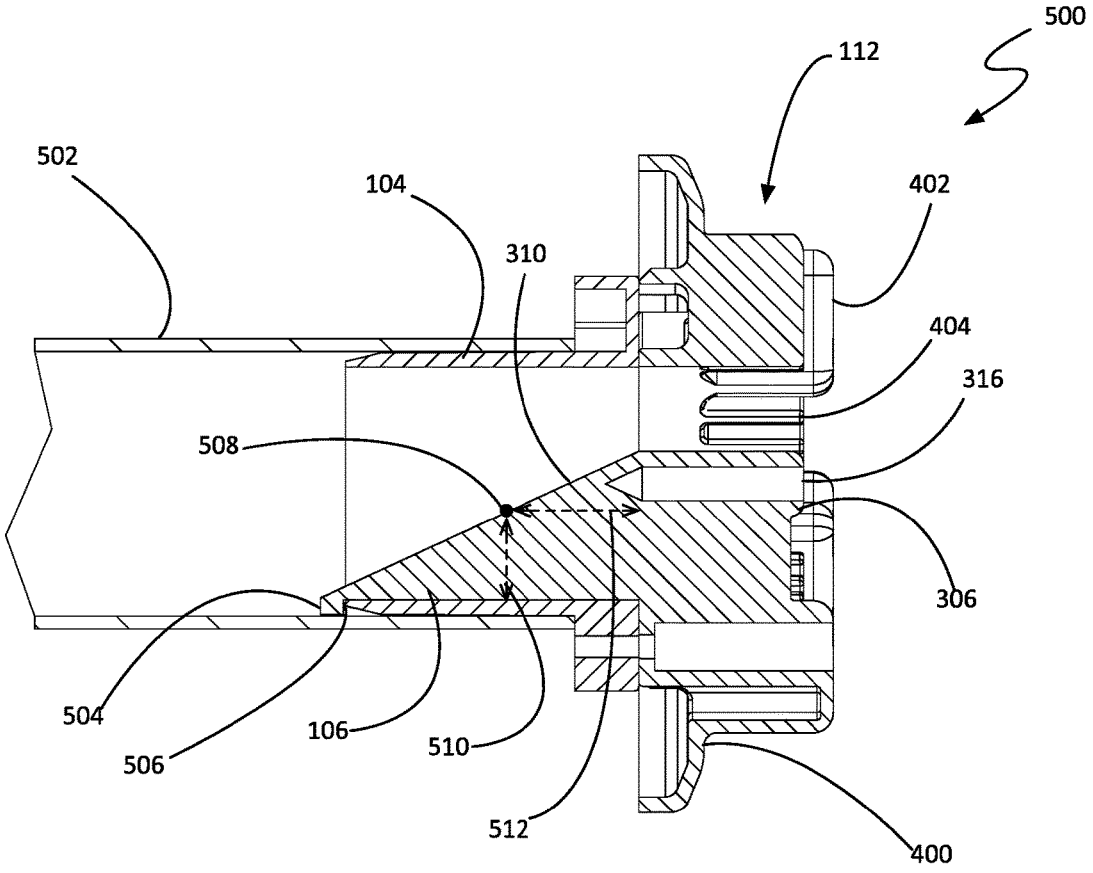
FIG. 5 is a cross sectional view of a pool return fitting assembly installed in a pool return pipe taken along section line B-B of FIG. 4.
Figure 6:
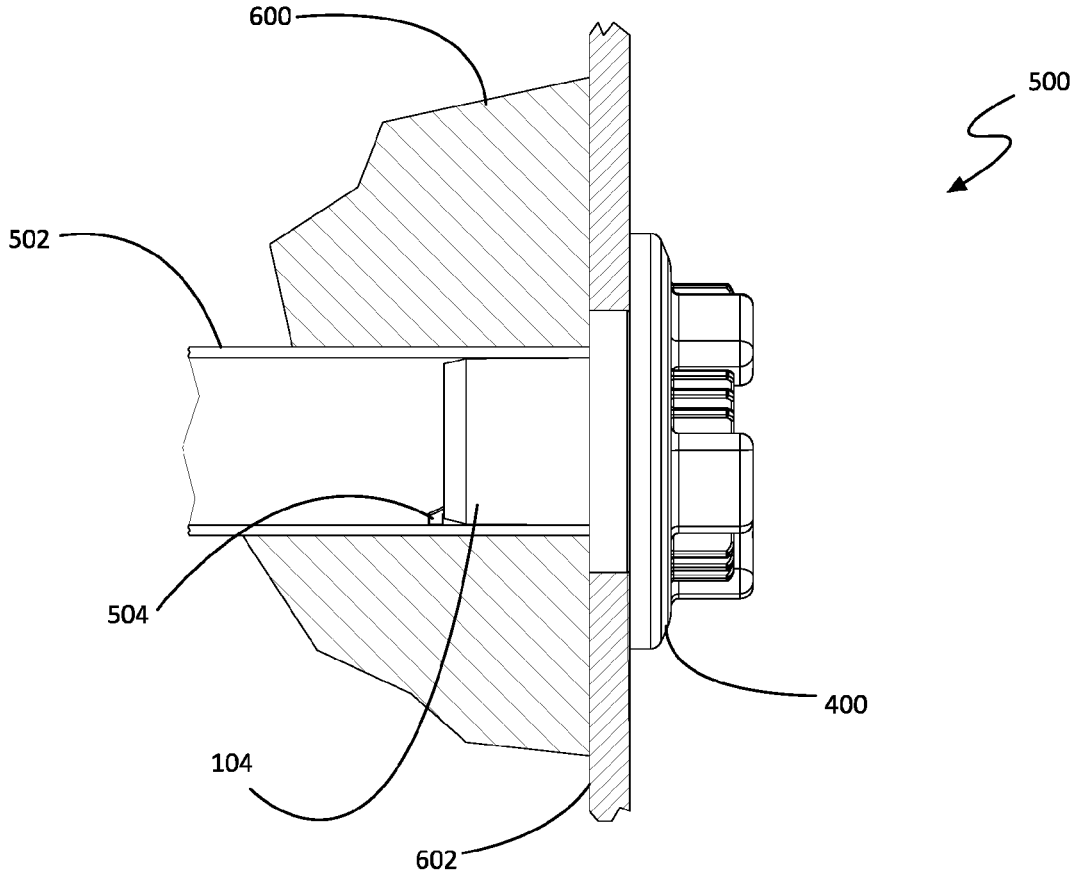
FIG. 6 is a cut-away side view of a pool return fitting assembly installed in a plaster swimming pool.
Figure 7A:
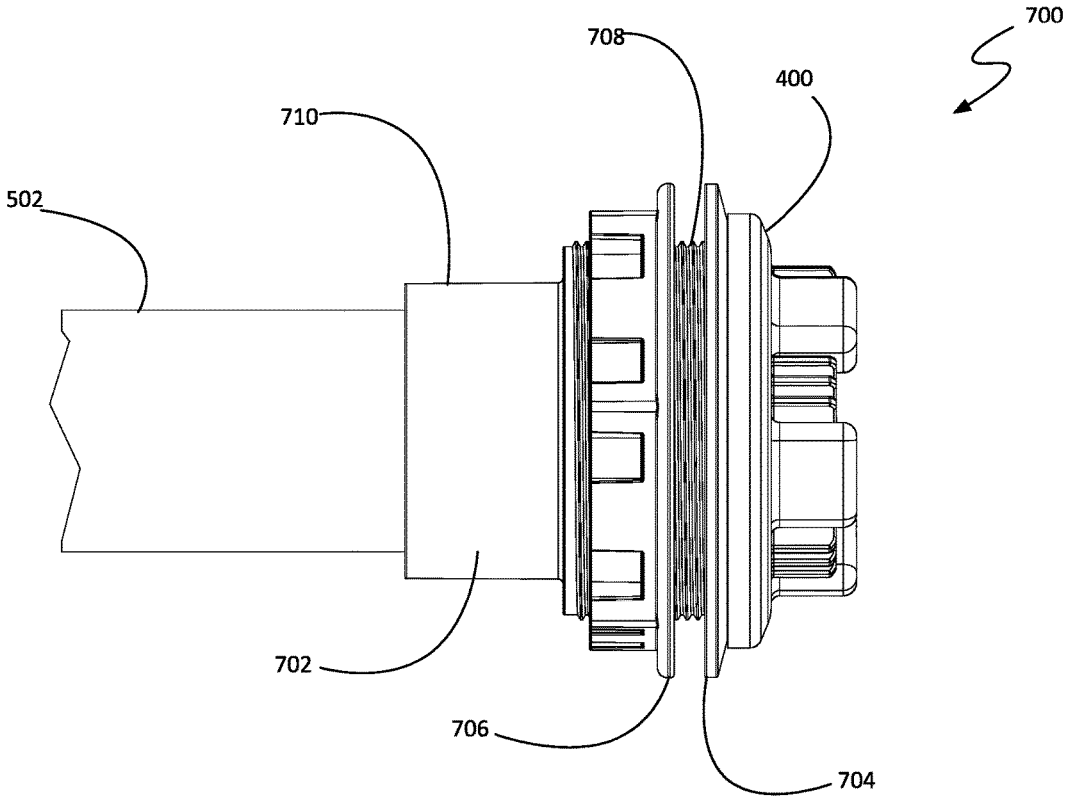
FIG. 7A is a side view of a pool return fitting assembly having a pool return fitting base.
Figure 7B:
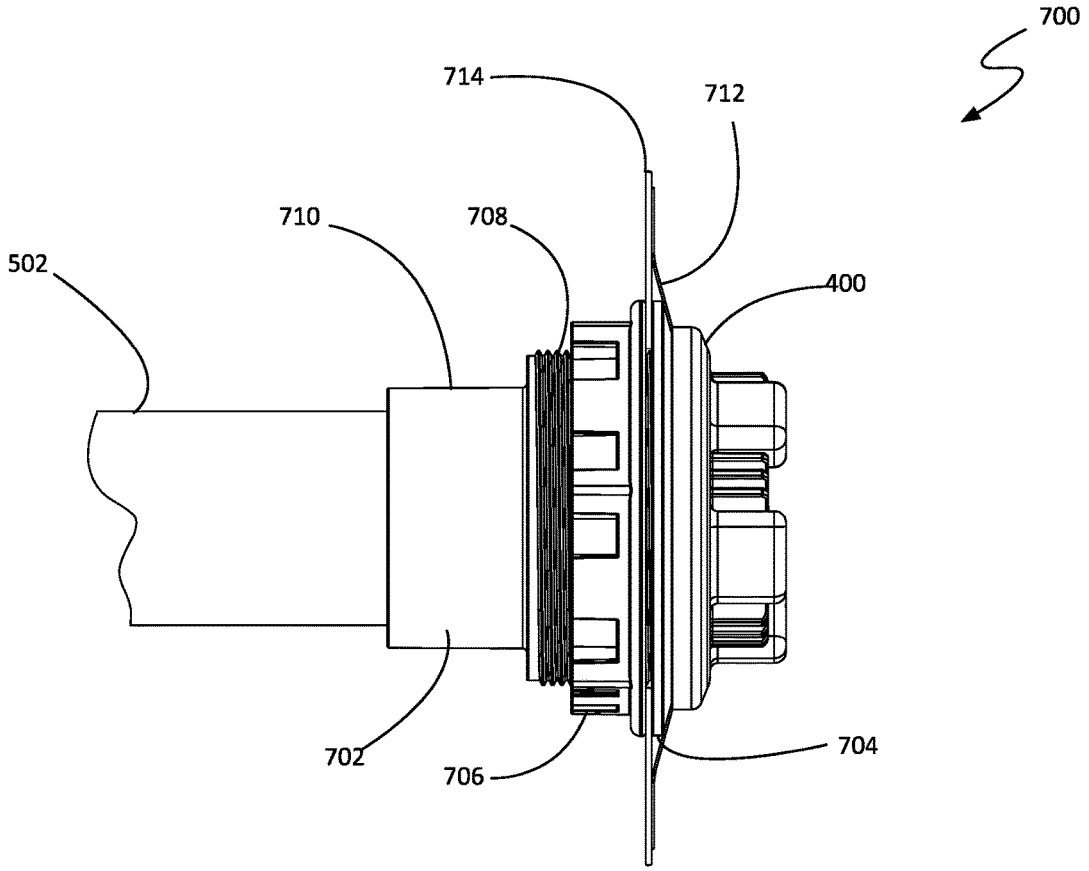
FIG. 7B is a cut-away side view of a pool return fitting assembly attached to a rigid wall pool with a vinyl liner.
Figure 7C:
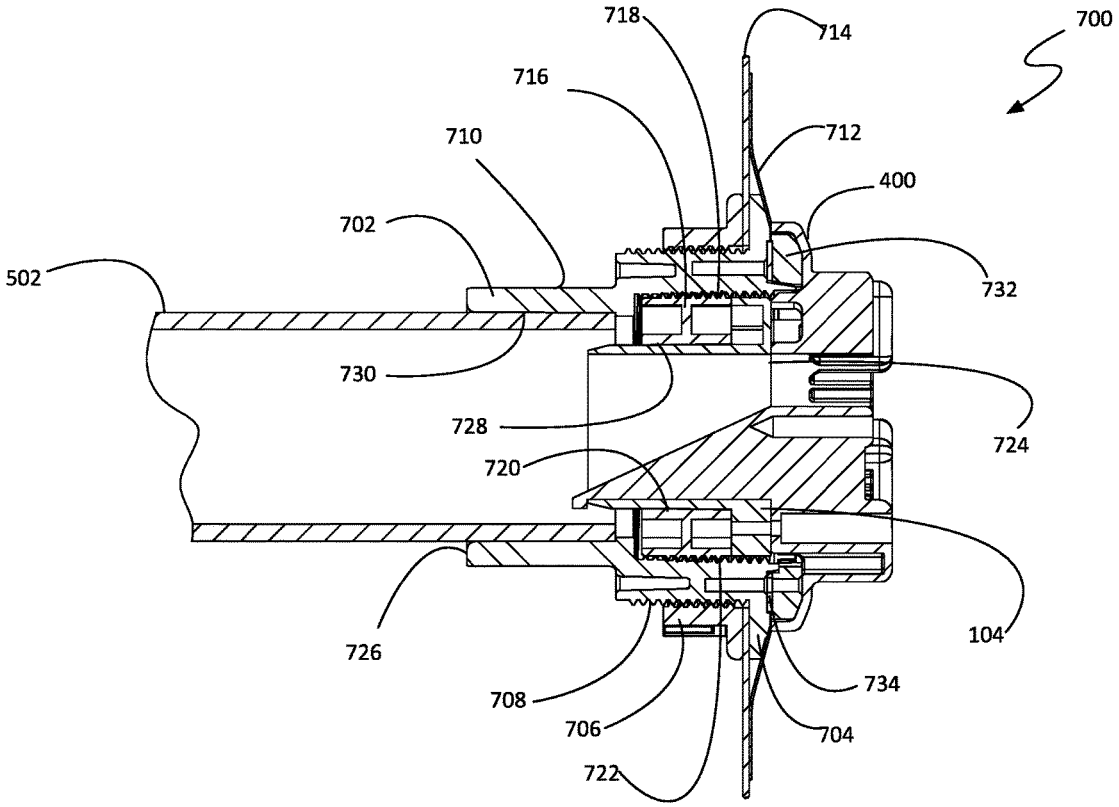
FIG. 7C is a cross sectional view of the pool return fitting assembly of FIG. 7B similar to FIG. 5, but for a vinyl liner pool.
Figure 7D:
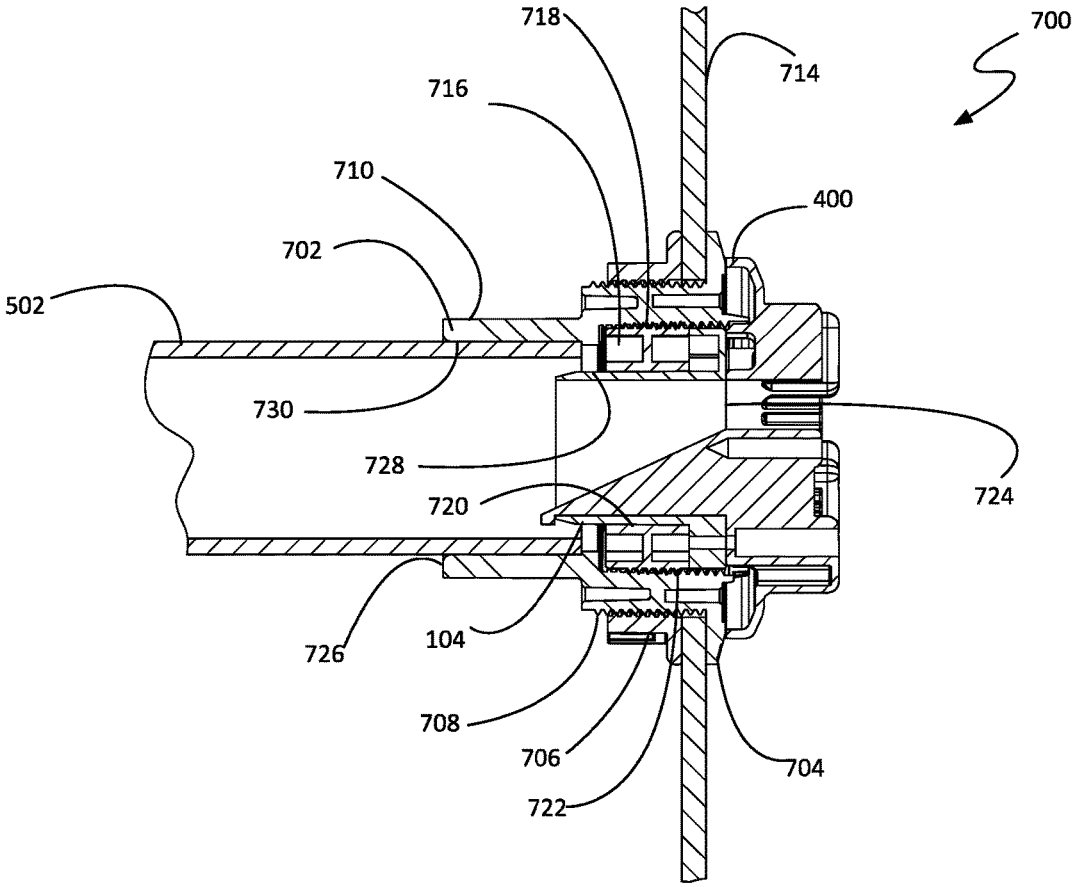
FIG. 7D is a cross sectional view of a pool return fitting assembly attached to a rigid wall pool similar to FIG. 5.
Figure 7E:
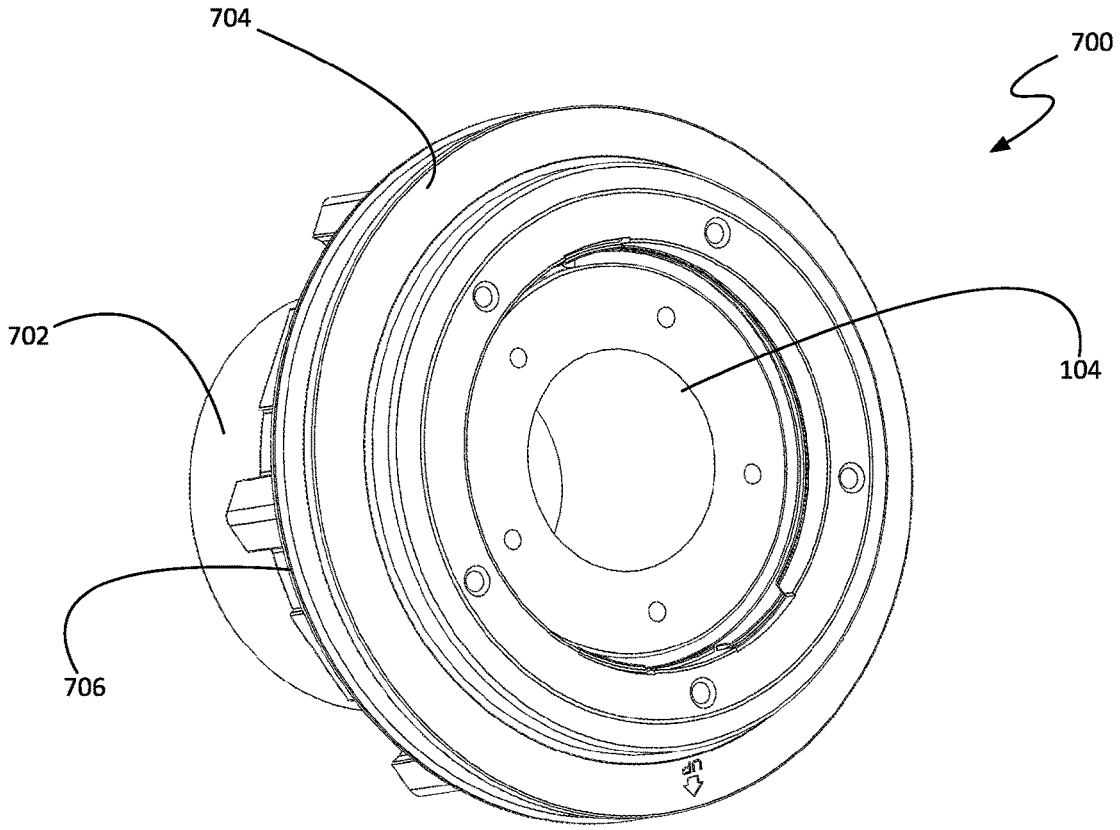
FIG. 7E is a perspective view of a pool return fitting assembly with the pool return cover removed.
Figure 8:
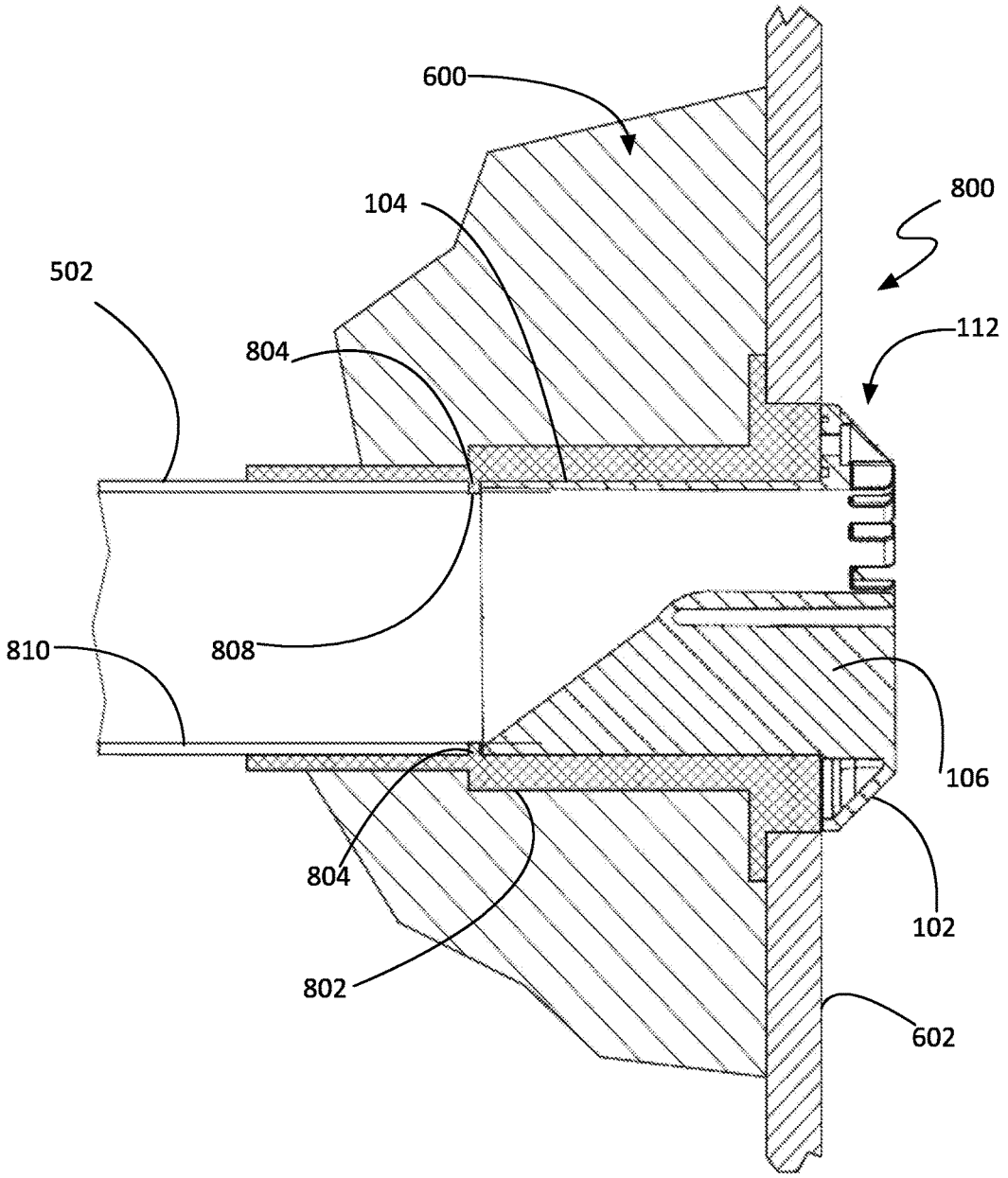
FIG. 8 is a cross sectional view of a pool return fitting assembly installed in a plaster swimming pool.

FIGS. 1-3 and 5-8 depict non-limiting examples of pool return fitting assemblies. Specifically, FIGS. 1-3 show fitting assembly 100, FIGS. 5 and 6 show fitting assembly 500, FIGS. 7A-E show fitting assembly 700, and FIG. 8 shows fitting assembly 800. Each of these non-limiting examples of a pool return fitting assembly comprises a pool return cover (e.g. cover 102 of FIG. 1, cover 400 of FIG. 5) having a fin 106, and a pool return body 104. Some embodiments also comprise a pool return fitting base, while others do not. Pool return fitting bases will be discussed in greater detail with respect to FIGS. 7 and 8.

Swimming pools often have pump systems which draw water from the pool through a skimmer basket and a filter before returning it through a pool return pipe. Conventional pool return fittings are designed to hide the pool return outlet behind a sleek and unobtrusive outer cover. Many obstruct the outlet with a divider or grate, to prevent objects, such as a child's hand, from being inserted and possibly lodged within the pool return pipe, potentially trapping the child underwater.

An obstructed pool skimmer system may cause the pool pump that normally pulls water from the pool through the skimmer basket to instead pull water through the pool return pipe, creating suction where a water jet would be expected. This vacuum effect can turn the aesthetic and safety features of a conventional pool return fitting into a potentially very dangerous hazard. The sleek outer cover may allow a seal to be formed with the skin or clothing of a swimmer, potentially trapping them underwater against the return cover with the suction power of the pool pump.

Furthermore, the dividers, grates, or other structures meant to keep small hands out introduce a new danger when water is being drawn into the pool return pipe. The hair or clothing of a swimmer may be sucked into the pool return, beyond the safety structure. The suction may cause the hair or clothing to twist or tangle on the other side of the safety structure, effectively tying the swimmer to the pool return fitting, trapping them underwater.

Various embodiments of a pool return fitting assembly contemplated as part of this disclosure are advantageous to conventional pool return fittings due to various structural configurations that address the dangers of a pool return reversing its flow direction. Unlike the smooth, often planar covers used in conventional pool return fittings, various embodiments of return assemblies contemplated herein have a discontinuous outer surface. Specifically, various embodiments include a pool return cover 102 which comprises a cover surface 108 that has a plurality of protrusions 110 projecting out into the pool. By breaking up the surface of the pool return cover, it is more difficult for a complete seal to be formed against the skin or clothing of a swimmer. The protrusions allow for fluid communication between the pool and the pool return pipe in a variety of directions, advantageous over the often planar nature of conventional pool return fitting covers. Various embodiments of the pool return cover will be discussed in greater detail below with respect to FIGS. 1-5.

Additionally, various embodiments of a pool return fitting assembly contemplated as part of this disclosure comprise structure which prevents a small hand from being inserted into the pool return without creating the risk of hair or clothing from becoming tangled and trapped on the other side. Specifically, various embodiments comprise a fin 106 that limits the size of the pool return outlet to child-safe dimensions while also being tapered away from the pool. The tapered nature of the fin 106 does not leave anything for hair or clothing to become entangled upon. Various embodiments of the fin 106 will be discussed in greater detail with respect to FIG. 3.

Although the particular embodiments discussed below sometimes describe use of the pool return fitting assembly in combination with particular pool couplings, the principles of the disclosure relating to the surface of the pool fitting (e.g. pool return cover 102, pool return cover 400, etc.) and the structural components for preventing hair entrapment (e.g. fin 106, etc.) may be applied to any pool return fitting where there is a risk of the pool return beginning to suck water.

FIGS. 1-3 show a non-limiting example of a pool return fitting assembly 100 comprising a pool return cover 102, a pool return body 104, and a fin 106. As shown, the pool return cover 102 comprises an aperture 118 that extends through the cover 102. The aperture 118 is surrounded by a cover surface 108. According to various embodiments, including those shown in FIGS. 1-3, the cover surface 108 is coplanar with the aperture 118; in other embodiments, the cover surface 108 may be non-planar.

As shown, a plurality of protrusions 110 project out from the cover surface 108 in the direction of the pool (or away from the pool return body 104). According to various embodiments, the protrusions 110 serve to prevent a continuous seal from being formed with a swimmer's body, clothing, or anything else when there is suction at the pool return. The protrusions 110 may be numbered, sized, shaped, and/or distributed about the cover surface 108 in a variety of ways, both uniform and non-uniform, so long as the spacing between the protrusions 110 allows for sufficient fluid communication between the pool and the return pipe while the primary pathway is covered (by a swimmer's body, for example) that any suction experienced may be resisted by a typical child.

Figure 4:
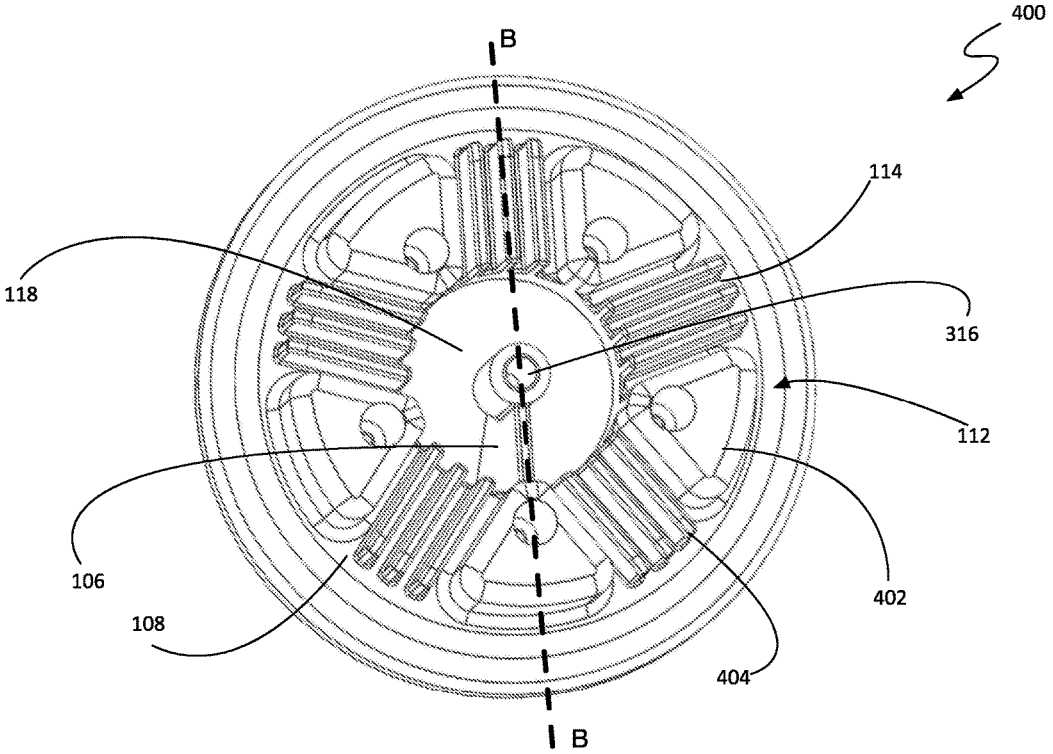
FIG. 4 is a perspective view of a pool return cover.

Uniform arrangements of the protrusions 110 are advantageous as they may directly flow from all directions evenly, making it more difficult for a continuous seal to be formed. According to various embodiments of the pool return cover, including the non-limiting examples shown in FIGS. 1-4s, the protrusions 110 may form a wall 112. In many of the non-limiting examples provided herein, the wall 112 includes barriers 116 that are notched, having spaces 114 between structures. The walls 112 having an uneven surface shown in the non-limiting examples of FIGS. 1 and 4 are circular; in other embodiments, the wall 112 may arranged as a square, a triangle, or any other polygon or irregular shape. A circular shape may be advantageous in that it may allow channels of fluid communication from a greater variety of directions than, say, a square.

A wall 112 comprises a plurality of channels 114 through the barriers 116. In many of the non-limiting examples provided herein, the channels 114 are formed as notches 114. An opening 114 may be a variety of shapes and sizes. In some embodiments, including those shown in FIGS. 1 and 4, the channels 114 of a wall 112 may be uniform throughout the wall 112. In other embodiments, openings 114 in a wall 112 may vary in size, shape, and/or orientation with respect to the wall.

The channels 114 of a wall 112 separate a plurality of barriers 116. In the context of the present description and the claims that follow, a barrier 116 is a structure neighbored by at least two channels 114. Barriers 116 may be a variety of sizes and shapes, yet all the same, according to various embodiments. For example, in the non-limiting example shown in FIG. 1, the barriers 116 of the wall 112 have a sloped outer surface, a rounded top, and a slightly curved inner surface, and are separated by channels 114 that are keyhole-shaped voids.

In other embodiments, the barriers 116 may vary within the same wall 112. For example, FIG. 4 shows a non-limiting example of a pool return cover 400 with a wall 112 having two types of barriers 116. A first type 402 is triangular in shape, while the second type 404 resembles a striation on the cover surface 108. These two types differ in shape, as well as height. According to various embodiments, the use of barriers 116 of multiple heights is advantageous, as it creates multiple planes that would have to be conformed to before a continuous seal could be made between the return fitting and a swimmer.

According to various embodiments, a pool return fitting assembly further comprises a pool return body 104, which is a channel having a first opening 302 and a second opening 304 and a tubular portion in between, as shown in FIG. 3. A pool return body may serve to couple the pool return cover 102 with a pool return pipe or pool return fitting base. In some embodiments, including the non-limiting examples shown in FIGS. 1-3, the pool return body 104 may be integrated with a pool return cover 102, being formed as a single piece. In other embodiments, such as the non-limiting examples shown in FIGS. 4-7, the pool return body 104 may be a separate piece coupled to a pool return cover.

A pool return cover 400 may be coupled with a pool return body 104 in various ways. FIG. 5 shows an non-limiting example of a pool return cover 400 couples with a pool return body 104 with screws (only screw receivers shown in FIG. 5) as well as a tab 504 at the end of a fin 106 coupled to the cover 400. Furthermore, a pool return body 104 may be a channel of various shapes. In some embodiments, the body 104 is cylindrical, and sized to fit within a conventional 2" pool return pipe, like pool return pipe 502 of FIG. 5. In other embodiments, the body 104 may have a different shape.

According to various embodiments, a pool return fitting assembly comprises a fin 106 that may be at least partially inside of the pool return body 104. The fin 106 serves to limit the size of what may be inserted into the pool return without the danger of a swimmer's hair or clothing becoming entangled with the pool return fitting. As will become apparent, this entanglement is avoided by tapering the fin as it gets deeper inside the pool return fitting assembly, removing any surface or feature that could catch hair, clothing, or anything with a closed loop or loose strings that may tangle and knot.

As shown in FIG. 3, the fin 106 comprises a facial edge 306 and an internal edge 310. In some embodiments, the facial edge 306 runs from a facial point 308 to the pool return body 104. In other embodiments, the facial edge 306 runs from a facial point 308 to the pool return cover 106. In some embodiments, the facial edge may be narrow and rounded; in others it may be broad and flat. As shown, the facial point 308 is near the plane of the first opening 302 of the pool return body 104. In some embodiments, the facial point 308 is inside the pool return cover 106, while in others it may be inside the pool return body 104.

The internal edge 310 runs from the facial point 308 to a tail point 312, according to various embodiments. As shown, the tail point 312 is a location that is proximate the interior surface 300 of the pool return body 104. The internal edge 310 is shaped such that there are no portions of the fin 314 upon which a closed loop, such as knotted hair, is likely to be snared. In some embodiments, the tail point 312 is on the interior surface 300 of the body 104, making the internal edge 310 run flush with the body 104. In other embodiments, the tail point 312 may be raised slightly from the interior surface 300, but not to the extent that a ledge or lip is created upon which a closed loop could be caught. In still other embodiments, a tail point 312 may not be the end of the fin; for example, in FIG. 5, the fin 106 has a tab 504 beyond the tail point 312 that couples with an edge 506 of the body 104 bordering the second opening 304 of the body 104.

As shown in the non-limiting examples of FIGS. 3 and 5, the fin 106 tapers, or reduces in height, as it's depth increases. In the context of the present description and the claims that follow, a height 510 of a point 508 is measured as the shortest distance (or distance normal to) between the point and the interior surface 300 of the pool return body 104 (or a surface coplanar to internal surface 300, if measuring a point outside the body 104). Additionally, a depth 512 of a point 508 is measured as the shortest distance (or distance normal to) between the point and the plane of the first opening 302 of the pool return body 104.

According to various embodiments, the internal edge 310 of a fin 106 does not have any structure on which a closed loop may be caught when pulled toward the pool. In some embodiments, this means that the height of any point on the internal edge 310 between the facial point 308 and the tail point 312 is defined by a continuous single-valued function depending upon the depth of the point. In the context of the present description and the claims that follow, a continuous single-valued function of height depending upon depth would be a function that only has a single height value for all depths in the domain. In other words, the function, and therefor the internal edge 310, does not hook back towards the pool return pipe, but rather traces a single path between the two points. In some embodiments, the function may be further constrained to be one-to-one, meaning all heights generated by the depths in the domain are unique. Such a function would steadily rise from the tail point 312 to the facial point 308, having no horizontal segments.

In some embodiments, the internal edge 310 may be smooth, while in others it may have corners or vertices, and may be composed of segments of linear edges, so long as none of the corners may act as a snare to a closed loop.

As previously discussed, the fin 106 serves to limit the size of objects that can fit inside the pool return fitting. As shown in FIG. 2, the fin 106 is sized and shaped such that the radius 200 of the largest sphere able to pass through the fitting assembly 100 is no greater than ½", diameter of 1", a dimension which may prevent the small hands of swimming children from being inserted and possibly trapped. FIGS. 2 and 3 show that the fin 106 has a bulge along the top of the internal edge 310, near the facial point 308. According to various embodiments, this bulge may serve to limit the size of inserted objects, as well as allow for a hole 316 to be centered in the fitting assembly, which may facilitate manufacturing. Other embodiments may not have a hole 316 and/or a bulbous fin segment.

In the non-limiting examples shown in FIGS. 3 and 5, the size of the largest insertable object is limited by the fin 106 at the facial point 308. In other embodiments, this size constraint may be achieved at a point along the internal edge 310 of the fin 106, which may have a greater height than the facial point 308.

As shown in FIGS. 2 and 4, the fin 106 may be planar in nature, according to some embodiments. In other embodiments, a fin 106 may be non-planar. For example, in one embodiment, the single-valued function defining the internal edge 310 of a fin 106 may depend upon depth as well as a polar angle with respect to the central axis of the pool return body 104.

The fin 106 is coupled to the interior surface of the pool return body 104, according to various embodiments. In some embodiments, including the non-limiting example shown in FIG. 3, the fin 106 may be integrated with the pool return body 104. In other embodiments the fin 106 and body 104 may be separate from each other. See, for example, the non-limiting example of FIG. 5, which shows a fin 106 having a tab 504 that is coupled to an edge 506 of the body 104.

Some embodiments of the pool return fitting assembly may be installed directly into a pool return pipe. For example, FIGS. 5 and 6 show a non-limiting embodiment of an installed assembly 500 wherein a portion of the pool return body 104 is inside a pool return pipe 502, such as but not limited to a 2" diameter return pipe. In some embodiments, the pool return body 104 may be sized such that the outer surface is mated with the inner surface of a pool return pipe 502. The embodiment shown in FIG. 6 is installed in a plaster pool, such that a flange on the pool return body 104 is embedded in the plaster 602 of the pool, while part of the pool return body 104 is within the pool return pipe 502 inside the concrete pool shell 600. In some embodiments, the fitting assembly may be configured such that the body 104 may be permanently mounted in a pool wall, such as the plaster and concrete wall of FIG. 6, while the cover 400 is removably coupled to the body 104, allowing for cleaning and maintenance.

Other embodiments of the pool return fitting assembly may further comprise a pool return fitting base, such as base 702 of FIGS. 7A-E and base 802 of FIG. 8. A pool return fitting base may serve to facilitate the installation of the fitting assembly. It is contemplated in this disclosure that embodiments of the fitting assembly described above may be utilized not only with plaster-covered pools, but also vinyl-covered pools. See, for example, the non-limiting embodiments shown in FIGS. 7A-D.

As shown, the pool return fitting assembly 700 comprises a cover 400 and a body 104 (not visible in FIG. 7A), in addition to a pool return fitting base 702. A fitting base 702 may comprise a tubular portion sized to receive a return pipe 502, such as but not limited to a 2" diameter return pipe. A fitting base 702 may further comprise a mounting flange 704 distal the tubular portion, and a first threaded surface 708 disposed between the flange 704 and the tubular portion. The first threaded surface 708 is configured to threadedly couple to threaded backing nut 706 (or backing unit), as shown in the non-limiting embodiment of FIGS. 7A-D. The backing nut 706 is adapted to pinch, hold, or otherwise position a polymer or steel pool wall 714 between the backing nut 706 and the flange 704 of the fitting base 702. As shall be described in greater detail below, a return fitting assembly 700 is configured to pinch, hold, or otherwise position a vinyl pool liner 712 in between the flange 704 of the return fitting 700 and the cover 400 on a side of the flange 704 opposite the polymer or steel pool wall 714.

FIG. 7C shows a cross-sectional view of a non-limiting embodiment of a return fitting assembly 700 adapted for use with a vinyl-covered pool. Various implementations and embodiments of a pool return fitting assembly may further comprise a body 104, a threaded collar 716, and a sealing ring 732.

According to some embodiments, a fitting base 702 comprises second threaded surface 722. The second threaded surface 722 may be on an inner surface 730 of the fitting base 702 and may be positioned directly inside from the first threaded surface 708 on the outer surface 710 of the fitting base 702. In one or more embodiments, the threaded collar 716 comprises threaded exterior surface 718 configured to threadedly couple to the second threaded surface 722 of the fitting base 702. The threaded collar 716 may be ring shaped such that when the opening of the threaded collar 716 is sized to receive and interface with the tubular portion of the body 104 when the threaded collar 716 is threadedly coupled to the fitting base 702 and the tubular portion of the body 104 is inserted through the opening of the threaded collar 716. In some embodiments, the tubular portion is coupled to the threaded collar 716 with an adhesive. When coupled, the mounting portion of the body may abut the threaded collar 716.

One or more embodiments of a pool return fitting assembly 700 further comprise a sealing ring 732. The sealing ring 732 is adapted to pinch, hold, or otherwise position a vinyl layer 712 between the sealing ring 732 and the flange 704 of the fitting base 702, as shown in the non-limiting embodiment of FIG. 7C. The sealing ring 732 may be coupled to the fitting base 702 with screws that extend through screw openings on the sealing ring 732 and into the screw receivers on the fitting base 702. The sealing ring 732 may further comprise a gasket 734 positioned between the sealing ring 732 and the fitting base 702 when the sealing ring 732 is coupled to the fitting base 702. The cover 400 may comprise a recessed channel on an inner surface of the cover 400, the recessed channel sized to receive and/or interface the sealing ring 732 opposite the flange 704 of the fitting base 702. The fitting base 702 may comprise a protruding ring extending away from the fitting base 702 distal the tubular portion and towards the cover 400. The sealing ring 732 may fit around the protruding ring of the fitting base 702. The recessed channel may comprise a channel wall that interfaces with the protruding ring of the fitting base 702 when the cover 400 is coupled to the body 104 and fitting base 702. FIG. 7D shows the same fitting assembly 700 applied to a rigid walled pool without a vinyl liner 712.

FIG. 7E shows a front view of a pool return fitting assembly 700 with the cover 400 removed. As shown, the body 104 may nest within the fitting base 702 when coupled to the threaded collar 716. The sealing ring 732 couples to the flange 704 of the fitting base 702. In the assembly 700 shown in FIG. 7E, a cover 400 could be coupled to the assembly 700 by inserting a fin 106 of the cover 400 into the tubular portion of the body 104 and inserting the sealing ring 732 into the channel on the inner surface of the cover 400, aligning the screw receivers of the body 104 with the screw holes of the cover 400, then coupling the cover 400 to the body 104 with a plurality of screws.

A pool return fitting assembly having a fitting base may also be utilized in plaster-covered pools, according to various embodiments. FIG. 8 shows a non-limiting example of a pool return fitting assembly 800 comprising a fitting base 802 adapted for use with the return pipe of a venturi pump system. A venturi system is advantageous in part due to the use of a return flow from the pump to create additional suction at the skimmer basket. Sometimes turbulence in this return flow caused by joints or edges within the return pipe system can disrupt the additional suction. Such a disruption may be prevented or reduced through the use of a fitting base 802 comprising an internal lip 804 on the interior surface of the base 802.

As shown in FIG. 8, the edge of the pool return body 104 is mated with the internal lip 804 such that the interior surface of the body 300 is substantially flush with the interior surface 808 of the internal lip 804 (i.e. the surface facing the central axis of the body). Furthermore, the base 802 is sized that the pool return pipe 502 fits inside, such that the exterior surface of the pool return pipe may be coupled with the interior surface of the base 802. Additionally, the edge of the pool return pipe is mated with the internal lip 804, such that the interior surface 810 of the return pipe is substantially flush with the interior surface of the lip 804 and the body 104, thereby facilitating laminar flow and reducing disruptions of the venturi system. It should be recognized by those skilled in the art that this method of reducing turbulence in the pool return fitting may be applied to other embodiments, including but not limited to those discussed above.

It should be understood that the covers, fins, bodies and bases described herein may be implemented together or separately, and may be adapted to other bases, bodies, and pipe couplings known in the art. Furthermore, where the above examples, embodiments and implementations reference examples, it should be understood by those of ordinary skill in the art that other pool return fitting assemblies and examples could be intermixed or substituted with those provided. In places where the description above refers to particular embodiments of fitting assemblies, it should be readily apparent that a number of modifications may be made without departing from the spirit thereof and that these embodiments and implementations may be applied to other to pool return fitting assemblies as well. Accordingly, the disclosed subject matter is intended to embrace all such alterations, modifications and variations that fall within the spirit and scope of the disclosure and the knowledge of one of ordinary skill in the art.

What is claimed is:

1. A pool return fitting assembly, comprising:

a pool return body comprising an opening therethrough;

a pool return cover comprising an opening therethrough aligned with the pool return body opening, the pool return cover comprising an uneven surface bordering the pool return cover opening and comprising a plurality of barriers projecting out from the pool return cover away from the pool return body, the plurality of barriers separated by channels in fluid communication with the opening through the pool return cover; and a fin positioned within the opening of the pool return cover, the fin comprising a facial edge and an internal edge, the facial edge extending from a facial point to one of the pool return body and the pool return cover, and the internal edge extending from the facial point to a tail point proximate an interior surface of the pool return body;

wherein at least a portion of the internal edge of the fin tapers towards the interior surface of the pool return body as the fin extends farther away from the pool return cover.

2. The pool return fitting assembly of claim 1, wherein the internal edge of the fin is shaped and positioned about a center of the opening of the pool return cover such that a largest radius of a sphere able to pass through the pool return cover opening around the fin is no larger than ½".

3. The pool return fitting assembly of claim 1, wherein the uneven surface comprises a plurality of protrusions comprising at least a first protrusion of a first type and at least a second protrusion of a second type that differs from the first type by at least one of a dimension and a shape.

4. The pool return fitting assembly of claim 1, wherein the pool return body is integrated with the pool return cover and the fin.

5. The pool return fitting assembly of claim 1, wherein the fin further comprises a tab extending through the pool return body, the tab directly coupled to an edge of the pool return body.

6. The pool return fitting assembly of claim 1, wherein the pool return body is sized to fit inside a pool return pipe.

7. The pool return fitting assembly of claim 1, further comprising:

a pool return fitting base having a mounting flange surrounding a first end sized to receive the pool return body, the first end of the base opposite a second end sized to receive a pool return pipe;

wherein the pool return body is inside the first end of the base, such that an exterior surface of the pool return body is coupled to an interior surface of the pool return fitting base.

8. The pool return fitting assembly of claim 7:

wherein the interior surface of the pool return fitting base comprises an internal lip;

wherein an edge of the pool return body farthest from the pool return cover is mated with the internal lip such that an interior surface of the pool return body is substantially flush with an interior surface of the internal lip facing a central axis of the pool return fitting base; and wherein the internal lip is sized such that the interior surface of the internal lip is configured to be substantially flush with an interior surface of a pool return pipe when the pool return pipe is received through the second end of the pool return fitting base.

9. The pool return fitting assembly of claim 7:

wherein the interior surface of the pool return fitting base comprises a first threaded surface proximate the first end;

wherein the pool return body is threadedly coupled to second threaded surface of the pool return fitting base through a threaded collar, the threaded collar having a threaded exterior surface and an interior surface directly coupled to the exterior surface of the pool return body;

wherein an exterior surface of the pool return fitting base comprises a first threaded surface proximate the mounting flange which is threadedly coupled to a threaded backing nut.

10. The pool return fitting assembly of claim 1:

wherein a height of any point on the internal edge between the facial point and the tail point is defined by a continuous single-valued function depending at least on a depth of the point;

wherein the depth of the point is measured as the distance of a point normal to the opening of the pool return cover; and wherein the height of the point is measured as the distance of a point normal to an interior surface of the pool return body.

11. The pool return fitting assembly of claim 10:

wherein the continuous single-valued function is one-to-one; and wherein the height of the tail point is less than the height of the facial point.

12. A pool return fitting assembly, comprising:

a pool return body comprising an opening therethrough; and a pool return cover comprising an opening therethrough aligned with the pool return body opening;

the pool return fitting assembly further consisting essentially of only one fin positioned within the opening of the pool return cover, the one fin comprising a facial edge and an internal edge, the facial edge extending from a facial point on the one fin to one of the pool return body and the pool return cover, and the internal edge extending from the facial point to a tail point proximate an interior surface of the pool return body;

wherein at least a portion of the internal edge of the one fin tapers towards the interior surface of the pool return body as the one fin extends farther away from the pool return cover.

13. The pool return fitting assembly of claim 12, the pool return cover further comprising an uneven surface bordering the pool return cover opening and comprising a plurality of protrusions projecting out from the pool return cover away from the pool return body, the plurality of protrusions separated by channels in fluid communication with the opening through the pool return cover.

14. The pool return fitting assembly of claim 12, wherein the plurality of protrusions form a wall comprising a plurality of channels and a plurality of barriers.

15. The pool return fitting assembly of claim 14, wherein the plurality of barriers comprises at least one barrier of a first type and at least one barrier of a second type that differs from the first type by at least one of a dimension and a shape.

16. The pool return fitting assembly of claim 12, wherein the one fin is sized and positioned such that a radius of a largest sphere able to pass through the aperture and pool return body around the one fin is no larger than ½".

17. The pool return fitting assembly of claim 12:

wherein the interior surface of the pool return fitting base comprises an internal lip;

wherein an edge of the pool return body farthest from the pool return cover is mated with the internal lip such that an interior surface of the pool return body is substantially flush with an interior surface of the internal lip facing a central axis of the pool return fitting base; and wherein the internal lip is sized such that the interior surface of the internal lip is configured to be substantially flush with an interior surface of a pool return pipe when the pool return pipe is received through the second end of the pool return fitting base.

18. The pool return fitting assembly of claim 17:

wherein a height of any point on the internal edge between the facial point and the tail point is defined by a continuous single-valued function depending at least on a depth of the point;

wherein the height of the tail point is less than the height of the facial point.

19. The pool return fitting assembly of claim 12, further comprising:

a pool return fitting base having a mounting flange surrounding a first end sized to receive the pool return body, the first end opposite a second end sized to receive a pool return pipe;

wherein the pool return body is inside the first end such that an exterior surface of the pool return body is coupled to an interior surface of the pool return fitting base.

* * * * *